United States Patent [19]

Fukuma et al.

[11] Patent Number: 4,737,782

[45] Date of Patent: Apr. 12, 1988

[54] LIQUID CRYSTAL DISPLAY DRIVE CIRCUIT WITH VARIABLE SEQUENCE OF BACKPLATE SCANNING AND VARIABLE DUTY FACTOR

[75] Inventors: Yoshitaka Fukuma, Yamatokoriyama; Tosaku Nakanishi, Nishinomiya, both of Japan

[73] Assignee: Sharp Kabushiki Kaisha, Osaka, Japan

[21] Appl. No.: 815,799

[22] Filed: Jan. 6, 1986

Related U.S. Application Data

[63] Continuation of Ser. No. 414,529, Sep. 2, 1982, abandoned.

[30] Foreign Application Priority Data

Sep. 9, 1981 [JP] Japan ..... 56-143038

[51] Int. Cl.[4] ..... G09G 3/36

[52] U.S. Cl. ..... 340/765; 340/784; 340/793; 340/805

[58] Field of Search ..... 340/756, 765, 793, 784, 340/805, 802

[56] References Cited

U.S. PATENT DOCUMENTS 3,594,778 7/1971 Herald et al. ..... 340/799

*Primary Examiner*—Marshall M. Curtis

*Attorney, Agent, or Firm*—Birch, Stewart, Kolasch & Birch

[57] ABSTRACT

A drive circuit is used to drive a data matrix liquid crystal display panel that can be applied to a variety of uses wherein said drive circuit either generates the backplate signal using any optional sequence or optionally provides any desired duty factor.

The drive circuit chip itself contains RAM, and in responding to the data contents in said RAM, both the backplate and segment signals are generated, where the drive circuit provides any desired sequence that can optionally be determined in accordance with the RAM data contents.

As an alternative embodiment of the present invention, the drive circuit chip comprises a built-in counter that determines the duty factor of the liquid crystal enable signals, where the duty factor can optionally be set by varying the operational conditions of said counter.

16 Claims, 14 Drawing Sheets

$S_0 \sim S_{63}$ segment pattern
$H_0 \sim H_{19}$ backplate pattern

LIQUID CRYSTAL DISPLAY DRIVE CIRCUIT WITH VARIABLE SEQUENCE OF BACKPLATE SCANNING AND VARIABLE DUTY FACTOR

This application is a continuation of application Ser. No. 414,529 filed on Sept. 2, 1982, now abandoned.

BACKGROUND OF THE INVENTION

The present invention relates to a drive circuit for a liquid crystal display panel.

Conventionally, the drive circuit of a liquid crystal display panel provides a constant sequence in generating the backplate signal at a certain predetermined duty factor. As a result, such a sequence cannot optionally be variable by any program operation.

Consequently, terminals of both the backplate and segment electrodes of the liquid crystal display panel have been fixed to the terminals of the LSI which makes up the drive circuits of the liquid crystal display panel.

Furthermore, since the duty factor remains constant, the sequence of generating the backplate signal cannot be controlled by means of the program operation. For example, the desired program operations cannot be performed when either the 1/16th or 1/18th of the duty factor when a particular duty factor different from that utilized by the drive circuit is preferred for use with the display. It is generally known that, due to specific characteristics of the liquid crystal display panel, the higher the duty factor (1/16th instead of 1/18th), the better the display quality.

For example, existing liquid crystal display panels cannot selectively develop a display with the 1/16th of the duty factor for better display quality during the normal mode nor with the 1/18th of the duty factor for a greater number of the picture elements, although it may slightly lower the display quality.

The primary object of the present invention is to provide a drive circuit for the dot matrix liquid crystal display panel, which either generates the backplate signal under any optional sequence or optionally provides any desired duty factor so that it can effectively be applied to a variety of uses.

The primary feature of the drive circuit embodied in the present invention is that a random access memory RAM is provided in the drive circuit chip where both the backplate and segment signals are generated in response to a specific data that is present in said RAM so that the drive circuit can optionally provide any desired sequence in generating the backplate signal in accordance with the relevant data stored in said RAM.

The second feature of the drive circuit embodied in the present invention is that the drive circuit chip comprises a counter that determines a specific duty factor for the liquid crystal enable signal, allowing the drive circuit to optionally provide any desired duty factor by merely varying the operational condition of the counter.

The third feature of the drive circuit embodied in the present invention is that the contents stored in the RAM that is in the drive circuit chip can be variable by the operation of an independent CPU (central processing unit), while using the data transmission and reception wires connected between the CPU and RAM, even the operational condition of the counter itself can also be variable.

BRIEF DESCRIPTION OF THE DRAWING

For better understanding of the present invention and for further objects and advantages, reference is made to the following detailed descriptions in conjunction with the accompanying drawings showing an embodiment of the present invention, wherein.

DETAILED DESCRIPTION OF THE INVENTION

Figure 1:
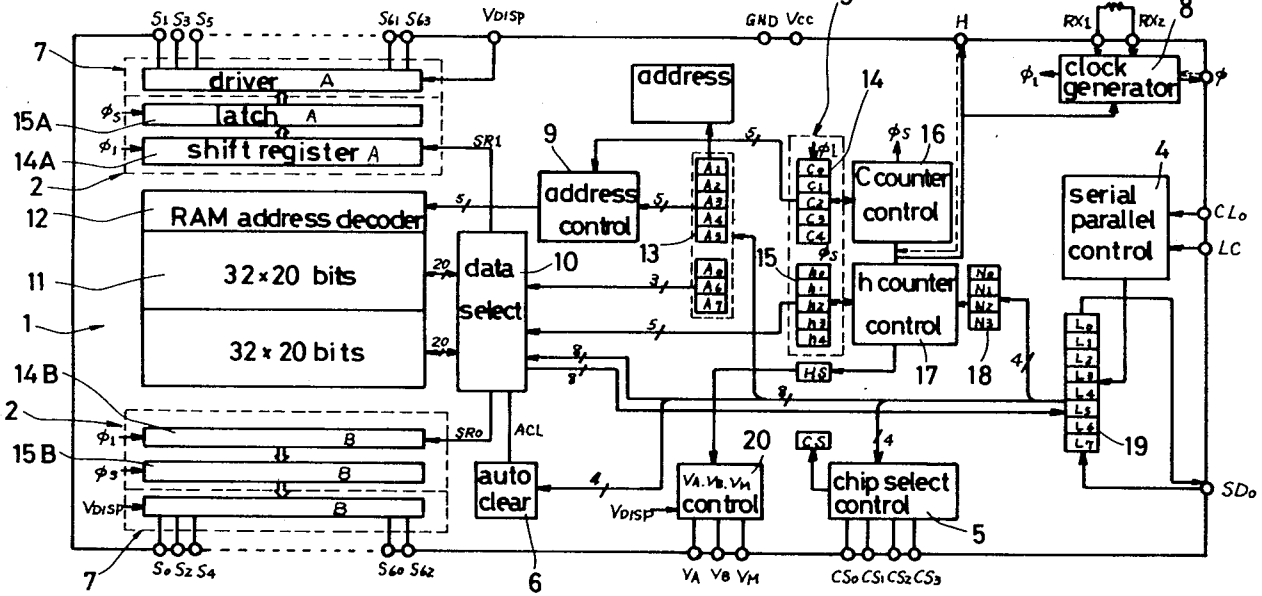
FIG. 1 shows a systematic block diagram of the drive circuit embodied by the present invention.

FIG. 1 shows a schematic block diagram of the entire construction of the drive circuit of the liquid crystal display panel as the preferred embodiment of the present invention.

The drive circuit (hereinafter called the driver) of the liquid crystal display panel (hereinafter called the LCD) embodied in the present invention consists of an LSI comprising;

RAM 1 that memorizes the display contents, shift registers 2 A and 2 B that receive the data from RAM 1 as the display signal, counters C and h designated generally by reference numeral 3 that generate signals for the LCD display, a serial and parallel signal conversion controller 4, a chip select controller 5, an auto clear controller 6, an LCD driver 7, and a clock pulse generator 8.

The LSI incorporates the following terminals connected to the terminals of external devices, which include;

Terminals S0 through S63 which are connected to either the segment or backplate electrodes of the LCD, power terminals Va, Vb and Vm which feed the power to the LCD, chip selector terminals CS0 through CS3 that provide the chip select signals, the synchronizing signal terminal H, and terminals CL0, LC, and SL0 connected to the CPU through the bus line.

Details of the driver embodied in the present invention are described below.

(1) RAM

Figure 2:
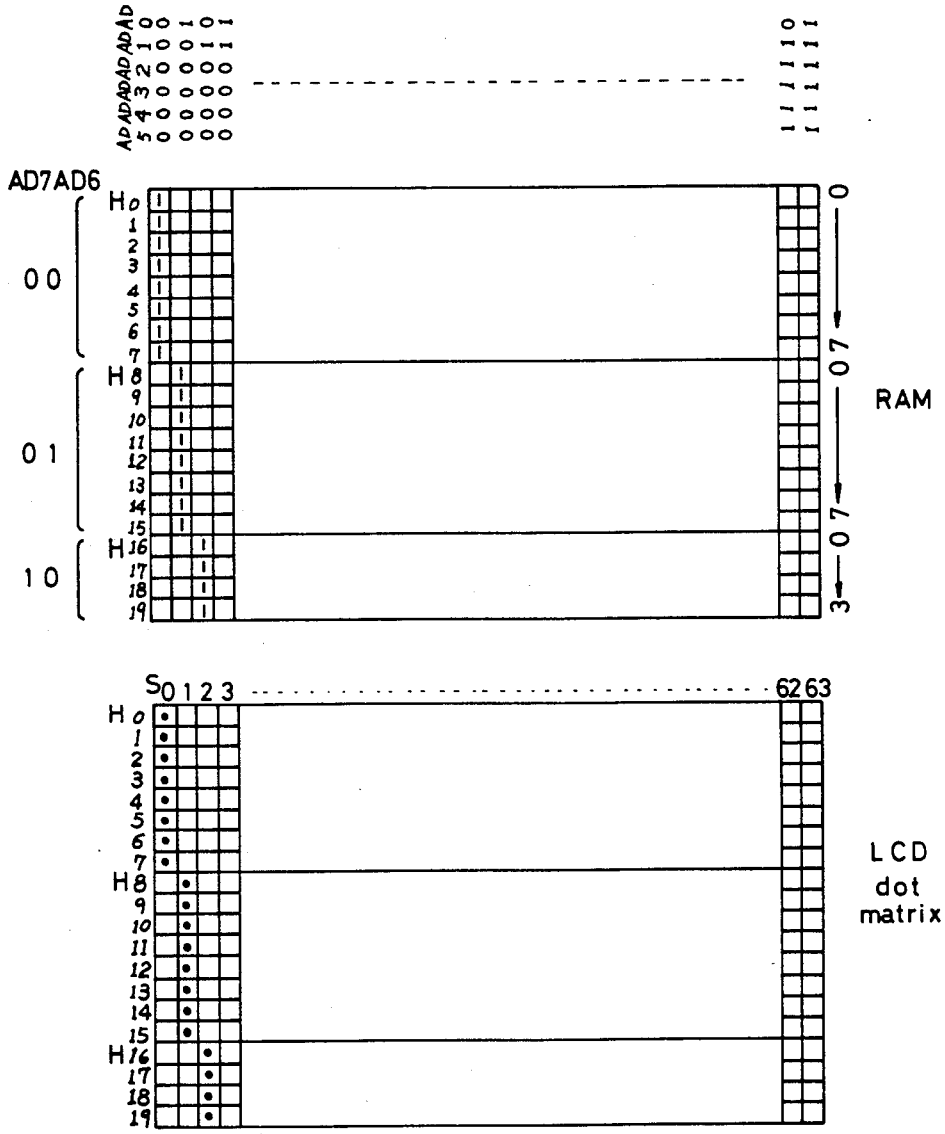
FIG. 2 shows a part of functional performances, representing the relationship of the contents between the RAM and display panel.

The drive circuit embodied in the present invention provides a RAM having a 60×20 bit construction, where each bit respectively corresponds to each display dot. The relationship of the contents stored by the display panel and RAM is shown in FIG. 2, wherein the positions AD0 through AD7 represent the RAM addresses. Positions AD0 through AD5 indicate binary digits within a row, whereas the positions AD6 and AD7 indicate them within a column.

Positions H0 through H19 represent the timing in processing the backplate signals, wherein the positions H0 through H7 correspond to the column selecting state AD6=0 and AD7=0, H8 through H15 correspond to the column selecting state AD6=1 and AD7=0, and positions H16 through H19 correspond to the column selecting state AD6=0 and AD7=1, respectively. On the other hand, positions S0 through S63 represent the segments determined by the row selecting states AD0 through AD5.

Figure 3:
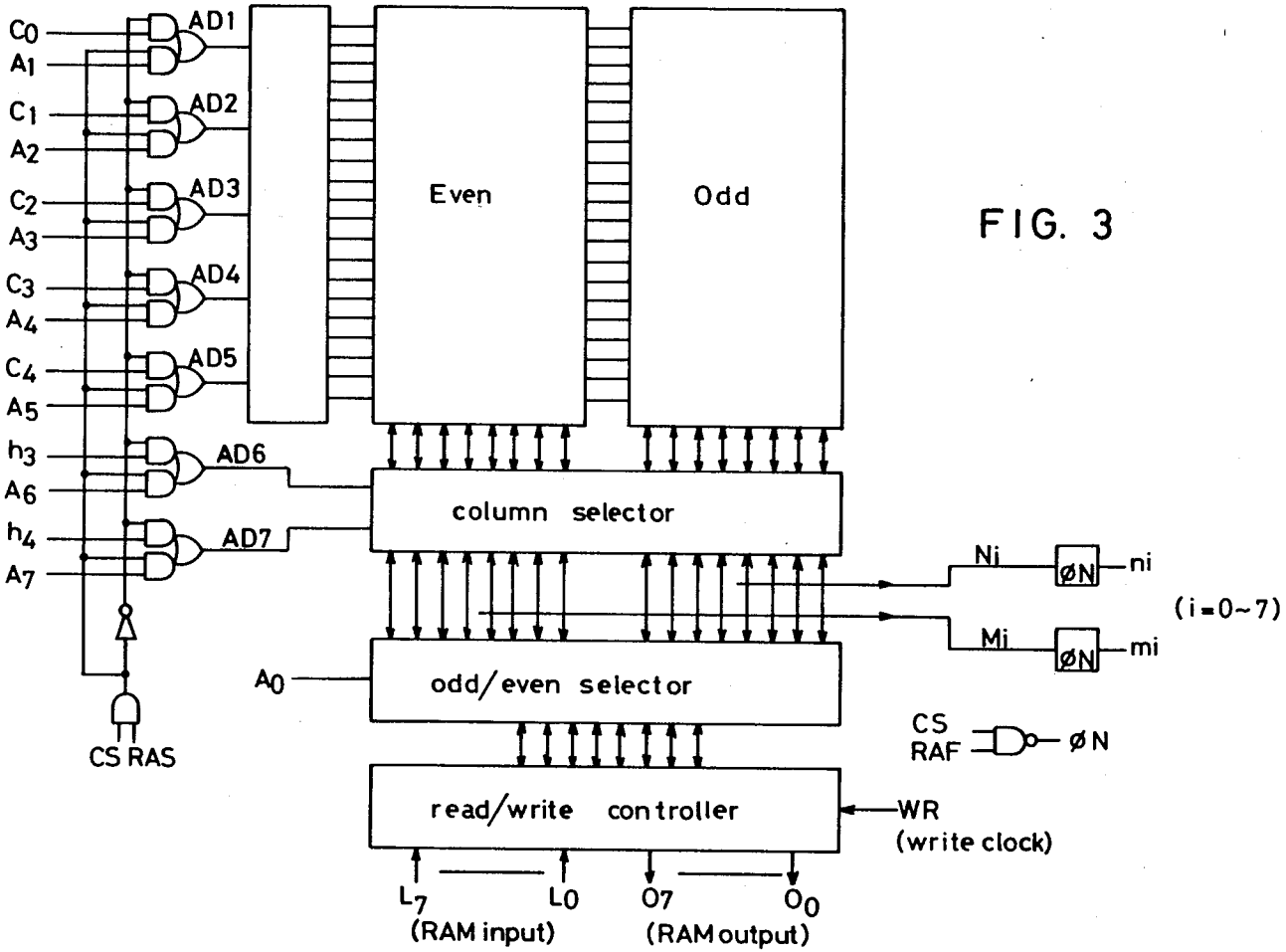
FIG. 3 shows a typical circuit arrangement peripheral to RAM shown in FIG. 1.

The RAM is divided into odd and even number portions as shown in FIG. 3. The address position A0 selects the binary numbers column by column, in order to fetch data from the memory after dividing both the odd and even signals and simultaneously transmitting it into the data to the shift registers independently.

As shown in FIG. 1, addresses A1 through A5 and C0 through C4 are provided so that they can correspond to addresses of the RAM, while addresses A0, A6, A7 and h0 through h4 correspond to the data selector, respectively.

Addresses C0 through C4 and h0 through h4 are provided in order to compose serial signals SR0 and SR1 which will sequentially draw the data contents out from of the RAM so that these contents can eventually be displayed by the LCD.

Addresses A0 through A7 13 compose flip flops (FF) for the RAM during a period when the data contents are sent out to any external device.

During a normal operation, in order to allow the LCD to correctly perform a display, C0 through C4 and h0 through h4 are used as the address and data selection devices for the RAM. On the other hand, any external data will be fed to RAM as an interruption signal.

Since certain addresses are usually provided to the RAM which then accept the interruption signals during this period, and also because these addresses are totally different from the normal addresses which provide the display data, the normal display data can be extremely disturbed, and as a result, the LCD will not be able to perform any display operation correctly.

To prevent this, the present invention provides a data buffer to the output port of the RAM which will then be able to correctly output stable display signals throughout the display operation irrespective of interruption caused at any time by the data transmission from external devices.

Details of the address controller 9 and data selector 10 are shown in FIG. 3.

In FIG. 3, CS represents the CS flip flop output signal shown in FIG. 1, while said CS will remain in the non-selected state when the mode is CS=1, of which detail will be described later. Both of the signals RAS and RAF will be generated only when data is sent from an external source.

When the signal RAS is generated during a period where CS=1, both the RAM addresses and selector will be switched to the addresss A1 through A7.

When neither the FF output signals CS=0 nor signal RAS is generated, addresses C0 through C4 and h3/h4 will be sent to the row-decoder of the RAM and to the column selector, respectively.

As described in section (3), addresses C0 through C4 and h3/h4 are the counter generated display signals for the LCD. As clear from the time chart shown in FIG. 6, for example, when the backplate signals H19 is generated, addresses h0 through h4 will remain "0", whereas the RAM column selector is designated to remain with AD6=AD7=0 and the data selector will remain with h0=h1=h2=0, and so m0, i.e., the zero bit line in the even number area in the RAM, will be scanned through the SRϕ by the counters C0 through C4, and as a result, a certain serial data train will be developed. Identical operations will be performed in the SR1.

In other words, while the backplate timing H19 still exists, certain display data fed during the ensuing timing H0 will be shifted in the shift registers A and B, where said display data will then be latched during the switching operation from H19 to H0 before the display data is eventually sent out.

After said display data is sent out, as a display signal, the RAM contents are then drawn out by the sequentially incremental operations of the counters h0 through h4.

Flip flops mi and ni shown in FIG. 3 are the latch type flip flops having a clock signal represented as $\phi=\overline{CS}\overline{RAF}$. If the signal either CS=0 or RAS is not generated, i.e., when ϕN is high, the contents of the inputs mi and ni will be output as of the existing condition. When the signal RAF is generated as of the existing condition where CS=1, i.e., if ϕN is low, then the data contents will remain unaffected.

Consequently, when the signals RAS and RAF are generated by the data transmitted to any external device, even though the RAM output data may have been varied to any other data, both the inputs mi and ni still memorize the correct display data before any variations takes place, thus the display signal can safely be preveted from any disturbance.

Since the signal RAS performs the switching of the RAM addresses, the RAF signal contains the RAS signal within itself so that even the slightest variation of the RAM output will not be sent to the flip flops mi and ni during the address switching operation. Functional operations of the signals RAS and RAF are described in the following section (4).

(2) Shift register

After being converted into serial signals, the RAM contents obtained in the byte unit are then output as a display signals, then the serial signals are sent to the shift register where the serial signals are then latched by the clock pulse $\phi S$ synchronized with the LCD signal, and as a result, segment signals are generated.

As shown in FIG. 1, the shift register is divided into two blocks, A and B, where the block A processes the odd numbers of the segments, whereas the block B processes the even numbers of the segments. This is because the output pins of the LSI must also be divided into two blocks from which the odd and even numbers will be output independently.

Figure 5:
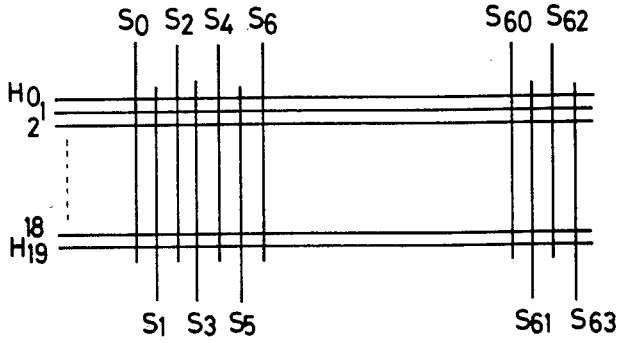
FIG. 5 shows the typical patterns of both the backplate and segments present in the liquid crystal display panel embodied in the present invention.

FIG. 5 shows a typical LCD pattern featuring the connections to the LSI which is virtually the driver of the LCD embodied in the present invention. Of a variety of applications possible for such a liquid crystal display, "KANJI" (Chinese character) and graphic displays are also included, which, however, need quite a large number of segments. Thus in order to properly output segment signals from the terminals of the LSI, these signals must be output after being divided into the upper and lower display positions at evey other interval due to the very limited terminal pitches available.

Thus, in order to enable the segment signals of the LSI to smoothly enter the terminals of the LCD segments without crossing each other, the LSI must output the segment signals divided into the odd and even numbers from output pins which can independently send out the odd and even numbers.

Shift register 14 is divided into two blocks, A and B, due to the reason described above and also in order to minimize the power consumption of the LSI which is the driver of the LCD.

Since the shift register is divided into two blocks, the RAM data contents can smoothly be transmitted to them using only 32 clock pulses.

On the other hand, if the shift register remains as of a single unit without being divided into two blocks, at least 64 clock pulses would be needed to smoothly transmit the entire amount of the RAM data.

In order to generate the 64 clock pulses necessary for a single unit shift register, for data transmission within a very short time, the oscillation of the reference clock pulse must oscillate at double the normal frequency. It will cause the LSI incorporating the CMOS to eventually double the normal power consumption.

(3) Counters h and C

Figure 6:
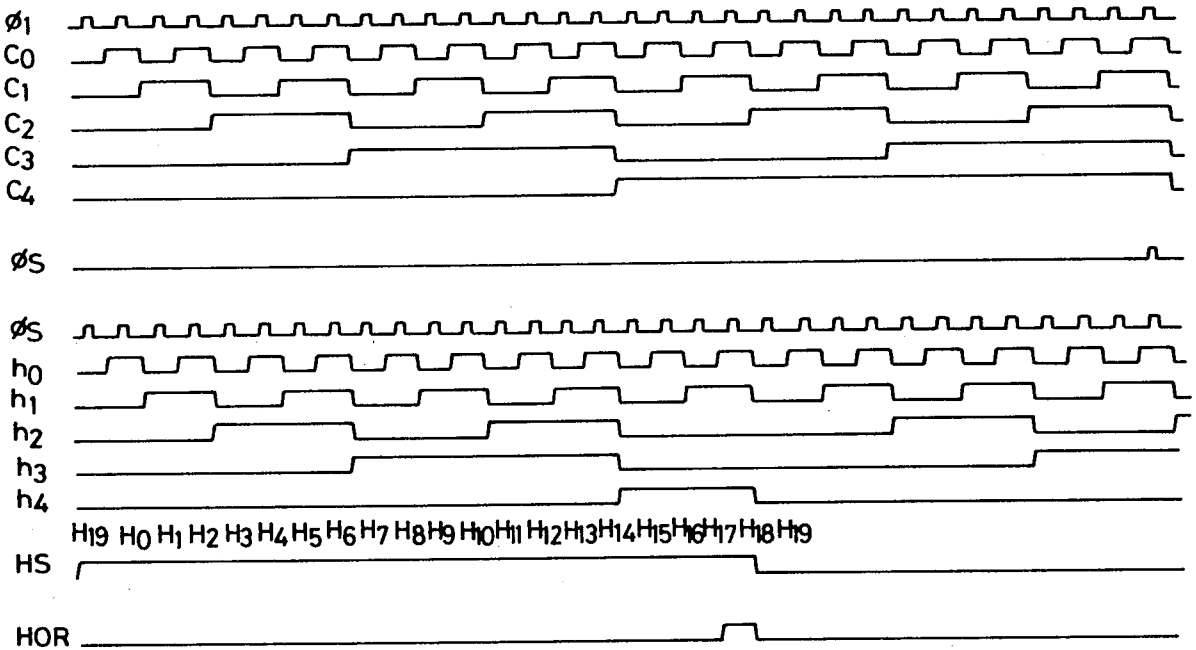
FIG. 6 shows a typical example of the signal performances relevant to the embodiment of the present invention, more particularly, showing a time chart representing the functional performances of the counters C and h.
Figure 7:
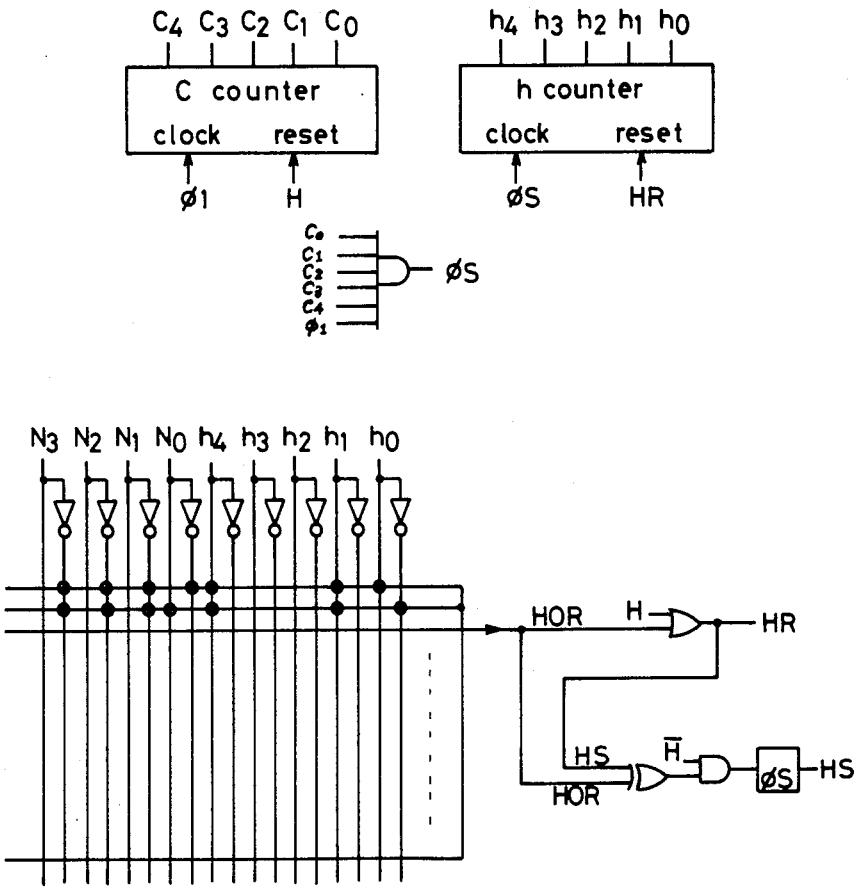
FIG. 7 shows the construction of the counters C and h and a block diagram of the peripheral circuit components embodied in the present invention.

FIG. 6 shows the time chart of the counters h and C. FIG. 7 also shows the counters h and C and the details of their peripheral devices.

Counter C performs counting operations using the reference clock pulse $\phi$ generated by the clock pulse generator 8 which generates the clock pulse $\phi S$ when the mode C4, C3, C2, C1, and C0=1 is present.

Sync signal H is sent to the reset terminals of the counter C, and this signal performs synchronizing operation.

Counter C is the 32nd notation counter using a clock pulse $\phi S$ and is reset when the mode $HR=H+HOR$ is present, where H represents the sync signal, while the reset signal HOR is determined by the value of the register N (N0 through N3) 18. This regsiter provides values sent from external devices.

ROM matrix shown in FIG. 7 is a device that generates the reset signal HOR for the counter h in accordance with the value of the register N.

The time chart in FIG. 6 shows that the reset signal HOR is generated by the timing when the waveform signals h4, $\overline{h3}$, $\overline{h2}$, h1 and h0 are generated, while the counter h remains the 20th notation.

Since the HS FF (flip flop) contains the clock pulse $\phi S$ and receives an input signal $\overline{H}$ (HS+HOR), synchronzing operation is performed by the sync signal H which inverts the reset signal HOR.

It is therefore very clear that the count number output from the counter h 15 determines the duty factor of the LCD backplate, allowing register N 18 to provide the specific duty factor.

Signal HS referred to in the above description represents a signal that composes an alternating voltage for delivery to the LCD.

(4) Serial/parallel controller.

Since all the internal data processing operations are performed in parallel and all the data are serially output, a serial/parallel counter must be provided.

In FIG. 1, register L 19 represents a shift register that performs bifunctional operations, either serial-in/parallel-out or parallel-in/serial-out.

In FIG. 1, SD0 represents the serial data bus, CL0 represents the serial transmission clock pulse, and LC represents the synchronizing signal.

8-bit data serially sent from an external device is temporarily memorized by register L 19, where said data is then used to compose either the RAM address, or the data for both the chip select controller and duty factor, or the data to be written in RAM.

The RAM data contents are first sent to register L 19 in parallel, which then outputs said data contents to the external devices as serial data by means of the shifting operation.

To correctly distinguish the kinds of various data transmitted, 2 bits are added in advance of the 8 bit serial data so that four binaries, 00, 01, 10, and 11, can be detected in order to transmit any of the required data. "00" activates writing of the duty factor and chip select data, "01" activates writing of the RAM address data, "10" activates writing of the RAM data, and "11" activates reading of the RAM data, respectively.

After either writing or reading of the RAM data is completed, RAM address A is automatically incremented by +1 position so that any complex address designation can be avoided, which, otherwise must be performed whenever a variety of data contents are continuously transmitted to and from RAM.

Figure 8:
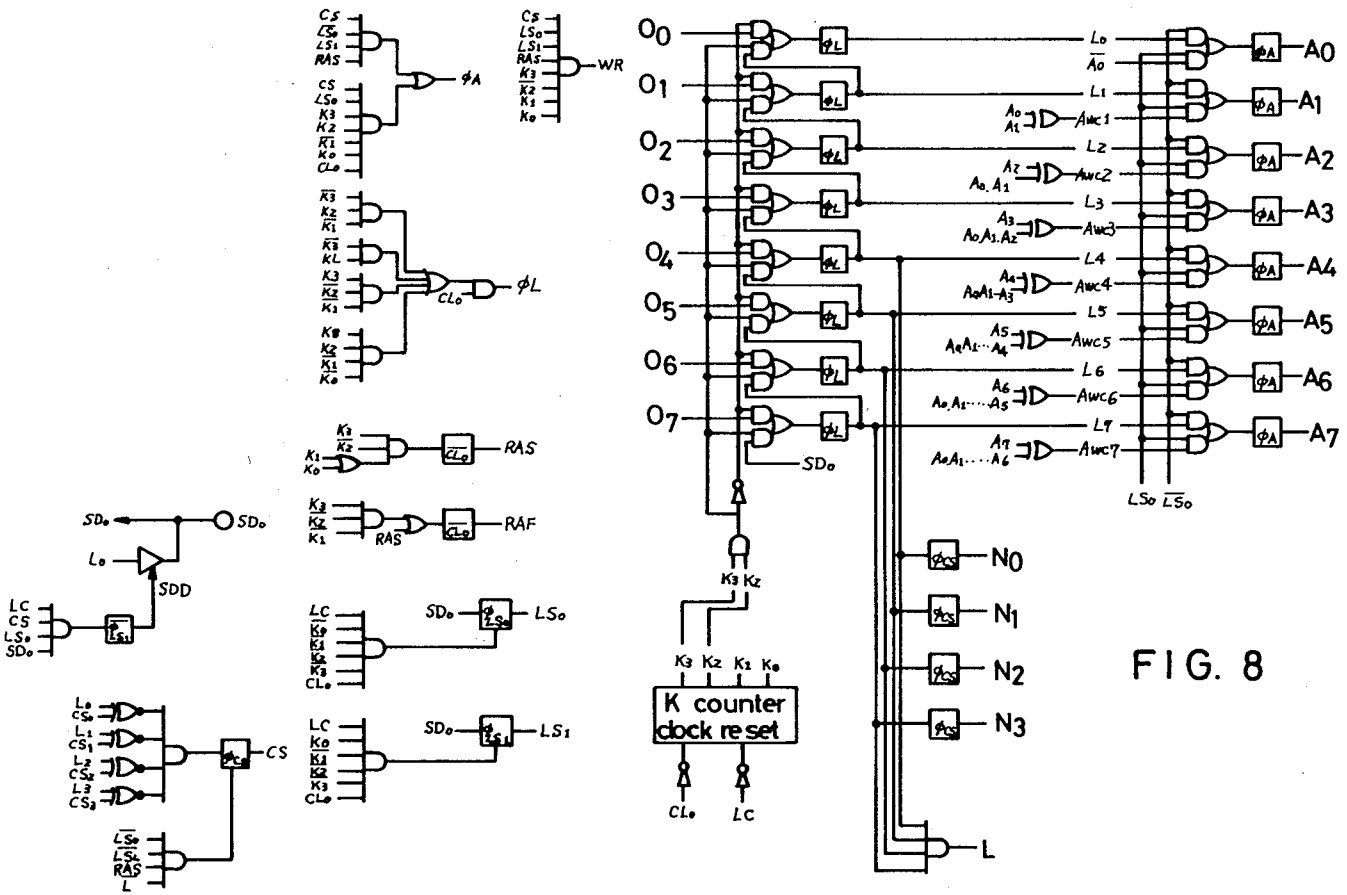
FIG. 8 shows a detailed circuit diagram of the serial and parallel data conversion control device embodied in the present invention.
Figure 9:
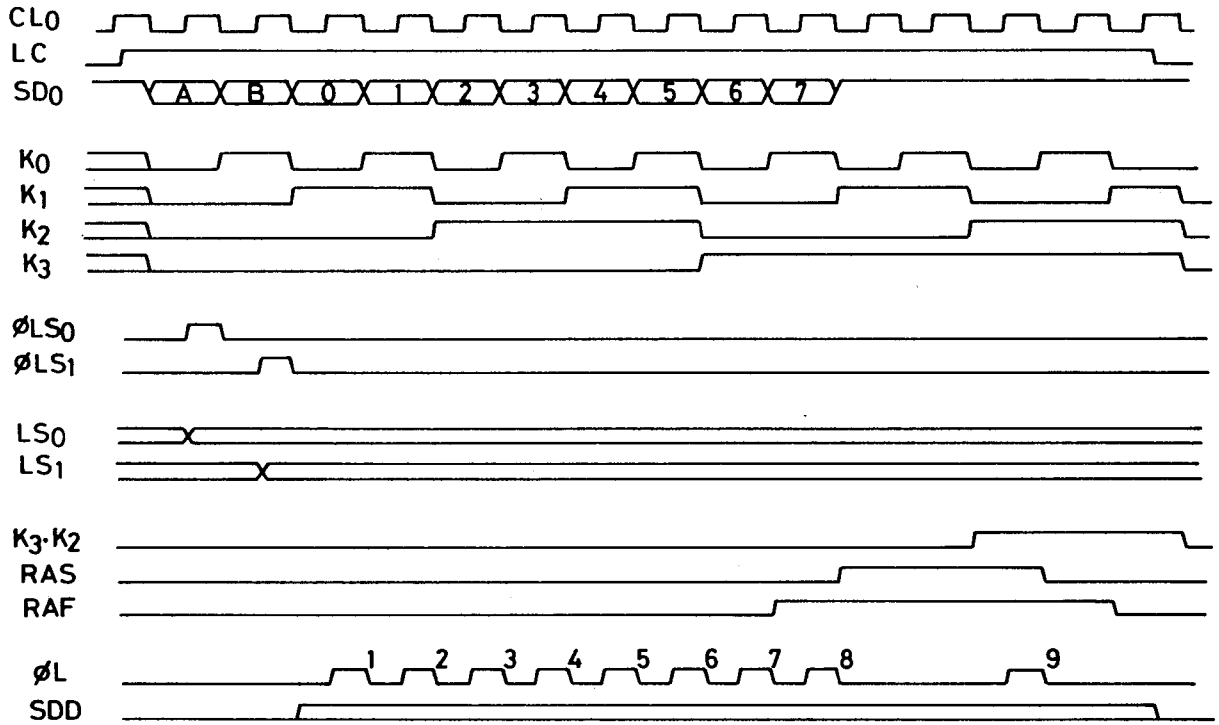
FIG. 9 shows the time chart illustrating the typical operations performed by said control device shown in FIG. 8.

FIG. 8 shows the detailed block diagram of the serial/parallel controller. FIG. 9 shows the time chart in relation to the transmission of the serial data.

Transmission of the serial data is activated at the rising edge of the synchronizing signal LC using the serial transmission reference clock signal CL0.

Counter K 21 which is a 4 bit binary counter, performs a counting operation when the sync signal LC remains "1", and is reset as soon as the sync signal LC turns to "0".

As soon as the counter K 21 completes the counting operation from number 0 up to 14, the serial data transmission operation is completed.

As described earlier, 2 bits are added to the 8 bits in order to distinguish the kinds of the data being transmitted.

Both the clock signals $\phi$LS0 and $\phi$LS1 receive the data contents from said 2 bit controller added, while flip flops LS0 and LS1 respectively memorize the contents A and B in the statics between the serial data transmission paths, as shown in FIG. 9.

Register L provides a clock signal $\phi$L that will be output only when the counter K 21 remains either 2, 3, 4, 5, 6, 7, 8, 9, or 12 of the clock numbers. Of these, the first eight (2 through 9) clock signals are shifted by register L, and the other (12) clock signal takes up the RAM data contents remaining in the LSI.

Signals K2 and K3 that control the input gate of register L 19 distinguish the first eight and the last clock signals.

Signal RAS is sent out while the counter K 21 remains either 10, 11, or 12 of the clock numbers, whereas the signal RAF is sent out when the counter K 21 remains either 9, 10, 11, 12, or 13. Signal RAS is used as the clock pulse for writing either the chip select control data, or duty factor, or addresses. This signal is also used for switching the addresses while either writing or reading of data contents in and out from RAM is performed. Signal RAF performs operations such as described in the first section of the detailed description of the present invention.

As shown in FIG. 8, SD0 represents the bidirectional data line. Normally, it receives input data, however, it outputs data when SDD flip flop remains "1". As shown in the time chart in FIG. 10, SDD is a flip flop that can be activated only when the RAM data is read out, where said SDD signal remains activated until the serial signal of the RAM data contents is completely sent out after the 2 bit control signal is fed.

WRITING OF THE CHIP SELECT DUTY FACTOR

Figure 10:
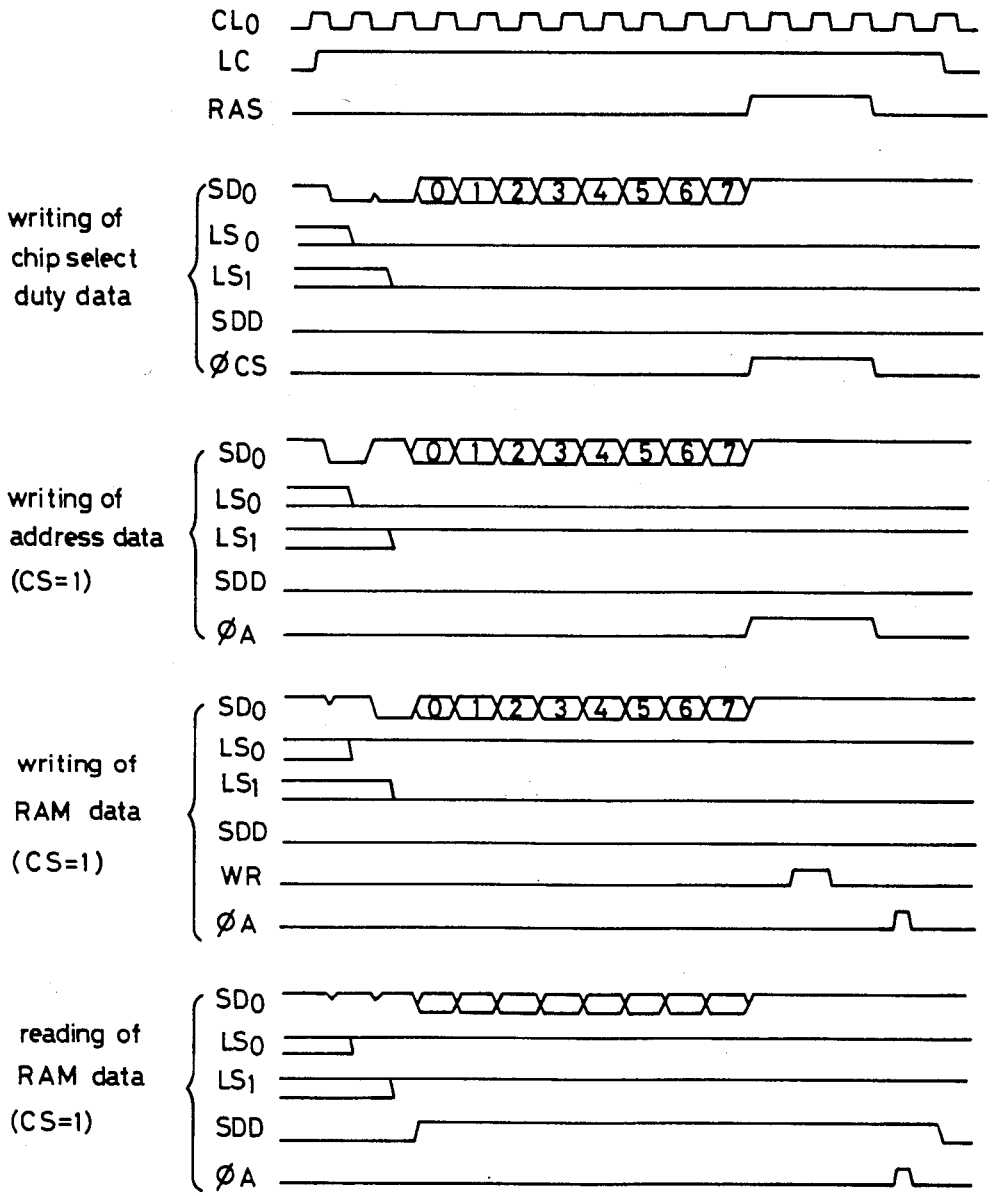
FIG. 10 shows a time chart illustrating the method of transmitting and receiving data signals between the drive circuit embodied in the present invention and the CPU.

A time chart in performing writing of the chip select duty factor is shown in FIG. 10.

When the control bit "00" is transmitted, both LS0 and LS1 remain in the mode LS0=0 and LS1=0, thus generating the clock pulse $\phi$CS. When the clock pulse $\phi$CS rises, the 8 bit serial data ensuing the control bit is already shifted in register L. Of the 8 bits, the contents of the upper 4 bits, L4 through L7, will be loaded in register N.

As shown by the input condition of the CS flip flop 22 in FIG. 8, if the code given to the external chip select pins CS0 through CS3 exactly matches the contents of the lower 4 bits, L0 through L3, of the 8 bit serial data, then the CS flip flop output signal will be activated, and if they do not match, then the CS signal will be reset.

In other words, when a chip select data is transmitted to a plurality of the driver LSIs, the CS signal selected in the chip will be activated so that it will perfectly match the code. All other CS signals that do not match the designated code will be reset.

If the mode L4=L5=L6=L7=1 is activated, then signal $\phi$CS will be inhibited.

This is because, when said mode exists, both the chip select data and duty factor must be inhibited to remain so that the auto clear mode can be released.

Address can be written in and any data can be transmitted to RAM only when the CS signal remains reset.

WRITING OF THE ADDRESS DATA

A time chart in performing writing of the address data is shown in FIG. 10.

When the 2 bit control signal "01" is activated, the mode will enter LS0=0 and LS1=1, thus generating the clock pulse $\phi$A. When this clock pulse rises, the 8 bit serial data ensuing the control bit data is already shifted in register L.

As shown in FIG. 8, since the mode remains LS0=0, address data sent out from the address flip flops A0 through A7 respectively enter the corresponding terminals L0 through L7 so that the writing of the address dats can be completed.

WRITING OF THE RAM DATA

A time chart in performing writing of the RAM data is shown in FIG. 10.

When the 2 bit control signal "10" is output, the mode will then enter LS0=1 and LS1=0, thus generating the clock pulse WR that will be written in RAM.

Figure 4:
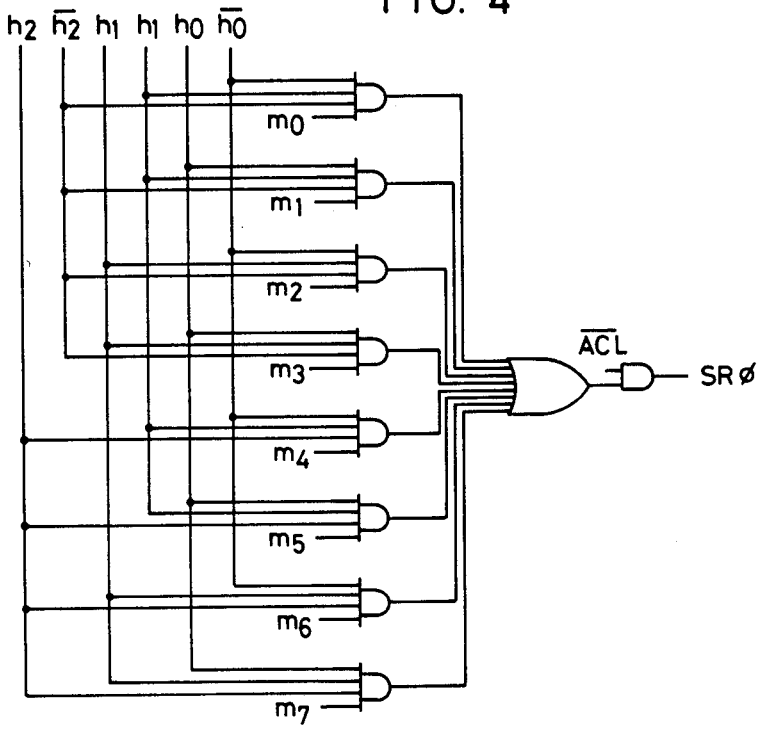
FIG. 4 shows a circuit arrangement peripheral to RAM shown in FIG. 1, more particularly, showing a circuit diagram where the signal either SR0 or SR1 is generated.

Clock pulse WR is generated by the cyclical periods of the RAS signals. When the RAS signal is being output, the 8 bit serial data ensuing the control bit is already shifted in register L. As shown in FIG. 4, terminals L0 through L7 respectively make up the RAM inputs with which the selected data will be written in RAM by means of the clock pulse WR.

RAS signal provides the addresses A0 through A7 for the row and column decoders, thus the selected data will be written in the addresses A0 through A7. As a result, a clock pulse $\phi$A will be generated in the address 13 (See FIG. 1).

Since the mode LS0=1 still exists as shown in FIG. 8, said clock pulse $\phi$A allows the addresses A0 through A7 to respectively gain +1 increment.

Thus, when any of the selected data must continuously be written in the internal RAM, addresses will have +1 increment each by merely receiving the written data without performing any designation when said addresses are activated, thus allowing RAM to quickly transmit the selected data to any desired destination.

READING OF THE RAM DATA

A time chart in performing reading of the RAM data is shown in FIG. 10.

When the 2 bit control signal "11" is sent to RAM, the mode then enters LS0=1 and LS1=1, and as a result, signal SDD will be activated by a bit that ensues the serial data.

As shown in FIG. 8, the lowest bit L0 of register L is provided for said signal SDD, while the contents of register L is shifted by the clock pulse $\phi$L, while said contents, as the serial data, will be sent out from the terminal SD0.

Note that register L 19 will memorize the RAM data that will be delivered to the addresses A0 through A7. This is due to the reasons described below.

Before reading of the RAM data is actually performed, four operations must always be performed as shown in FIG. 10. Both the clock pulse $\phi$L and RAS signal shown in FIG. 9 are constantly provided commonly during each of the four operations.

When the clock pulse $\phi$L eventually rises and since the RAS signal is sent to RAM, address A0 through A7 are provided, then the RAM contents represented by A0 through A7 are sent out from the RAM output terminals 00 through 07.

On the other hand, as shown in FIG. 8, register L 19 provides the input terminals 00 through 07, and when the clock pulse $\phi$L eventually rises, using the rising edge of this pulse, the RAM data contents represented by A0 through A7 are read into the input terminals 00 through 07 of register L 19. As a result, when performing reading of the RAM data from the start, register L 19 constantly memorizes the entire RAM data contents which are then sent out to an external device by the shifting operation in order to complete reading of the RAM data contents.

Due to the same reason as in writing the RAM data, the clock pulse $\phi$A will be generated during the last period of the RAM data reading operation.

(5) LCD driver

Figure 11:
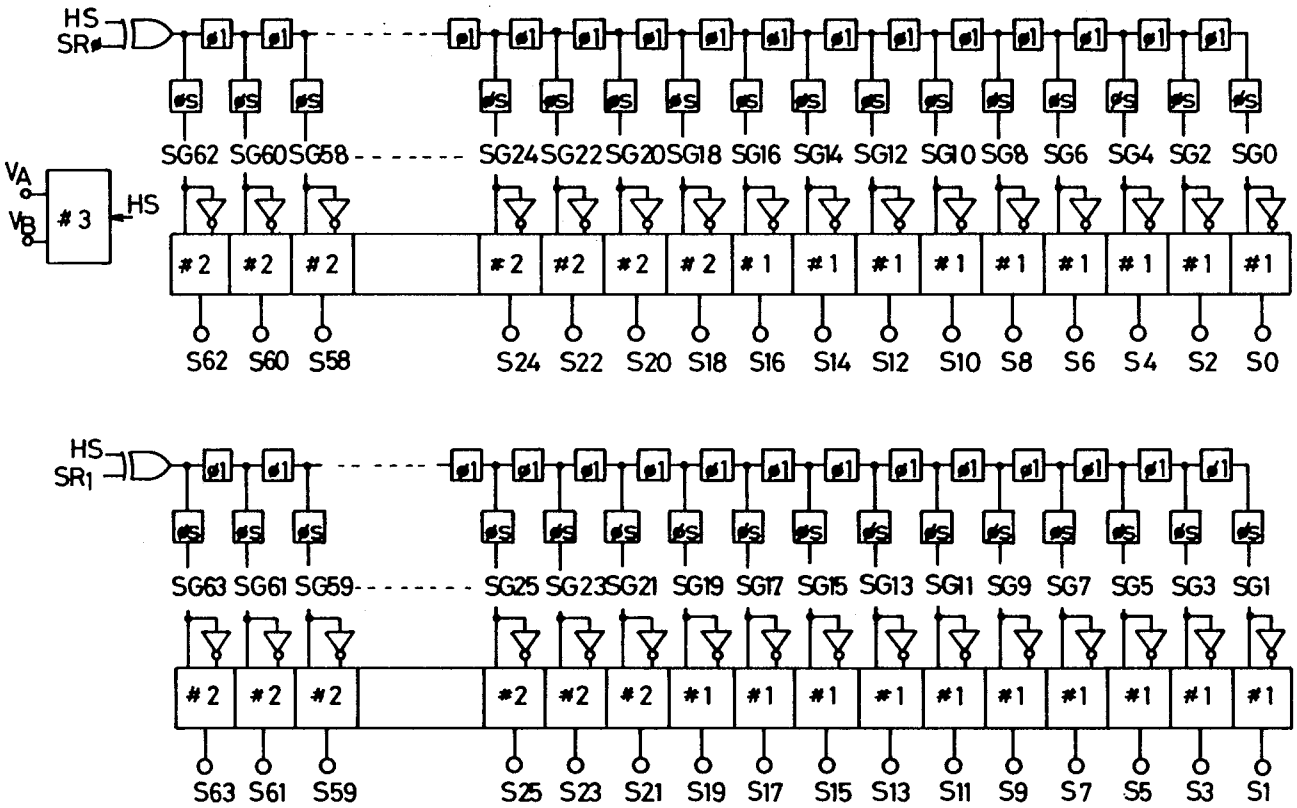
FIG. 11 shows the detailed diagram of the shift register, latch, and the driver embodied in the present invention

A detailed diagram of the LCD driver is shown in FIG. 11.

Exclusive OR signals comprising HS/SR$\phi$ and HS/SR1 are sent to the shift register. These inputs signals generate inversion signals synchronously with the signal HS.

Clock pulses $\phi$l and $\phi$S shown in FIG. 11 are identical to those clock pulses $\phi$ and $\phi$S in the time chart shown in FIG. 6.

Signals SR$\phi$ and SR1 that are converted into serial data are then shifted in the shift register by the clock pulse $\phi$1, then latched to the next flip flop by the clock pulse $\phi$S.

Symbols SG0 through SG63 shown in FIG. 11 represents the segment signals that are latched synchronously with the clock pulse $\phi$S.

Figure 12:
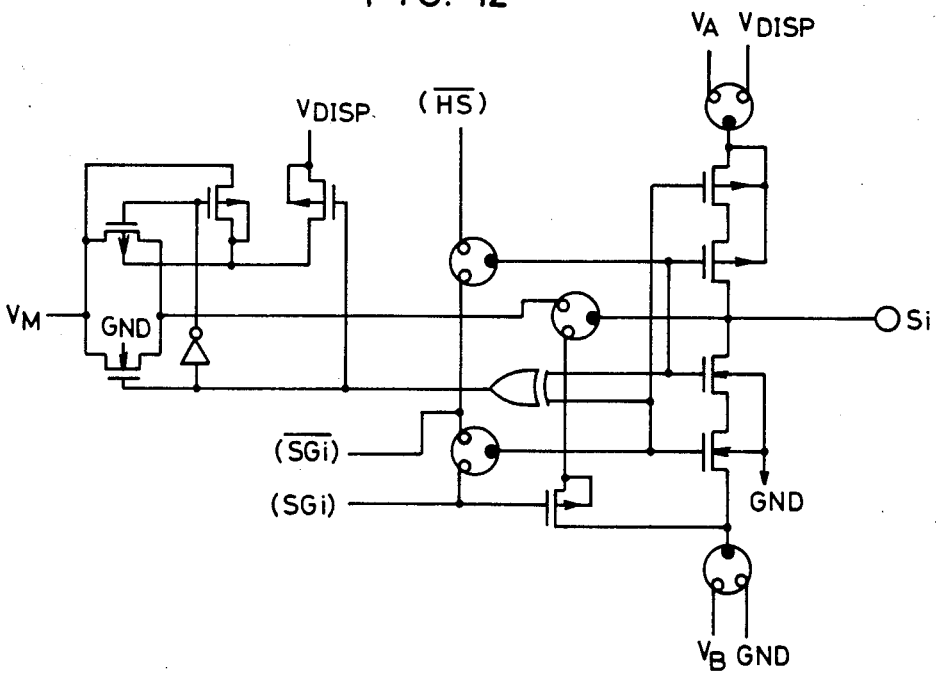
FIG. 12 shows a block diagram of the first LCD driver cells shown in FIG. 11.
Figure 13:
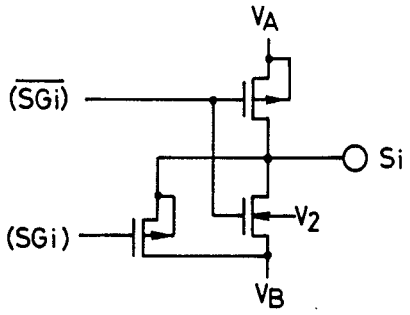
FIG. 13 shows a block diagram of the second LCD driver cells shown in FIG. 11.

Symbols #1 and #2 respectively represent the LCD driver cells, the construction of which is shown in FIG. 12 and 13, respectively.

Nore that FIG. 13 shows the driver that drives the segments in the LCD, while the driver shown in FIG. 12 drives both the segments and backplate of the LCD and comprises the driver cell that can easily be converted into either the segments or backplate by merely changing the mask of the LSI.

In the preferred embodiment of the present invention, signals S0 through S19 use the driver cell that corresponds to the #1 type, while these signals, S0 through S19, can be sent out as available for either the backplate or segments.

Figure 14:
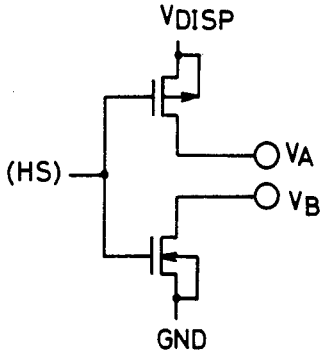
FIG. 14 shows the third LCD driver cell shown in FIG. 11.
Figure 17:
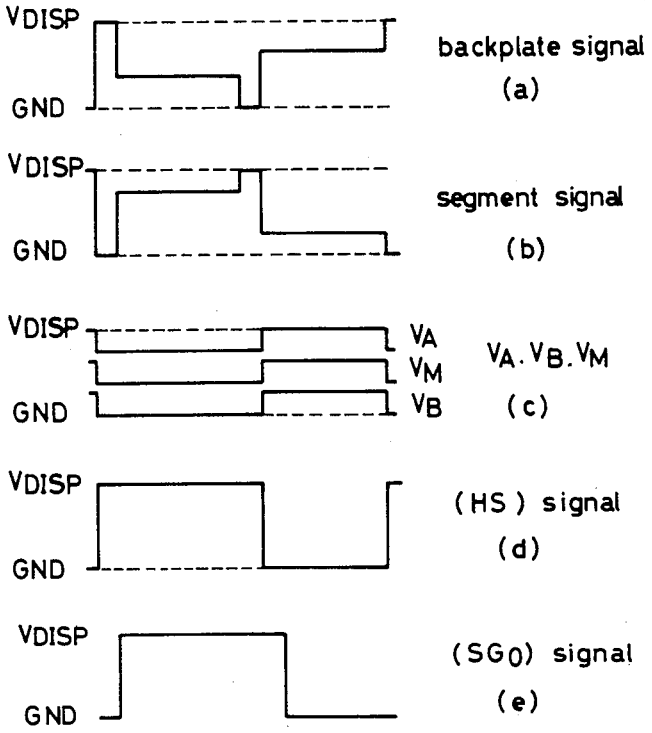
FIG. 17 shows the signal waveform generated by the drive circuit of the liquid crystal display panel embodied in the present invention.

FIG. 14 shows a diagram of the power circuit of the LCD driver, where signals perform operations as shown in the time chart of FIG. 17.

Figure 15:
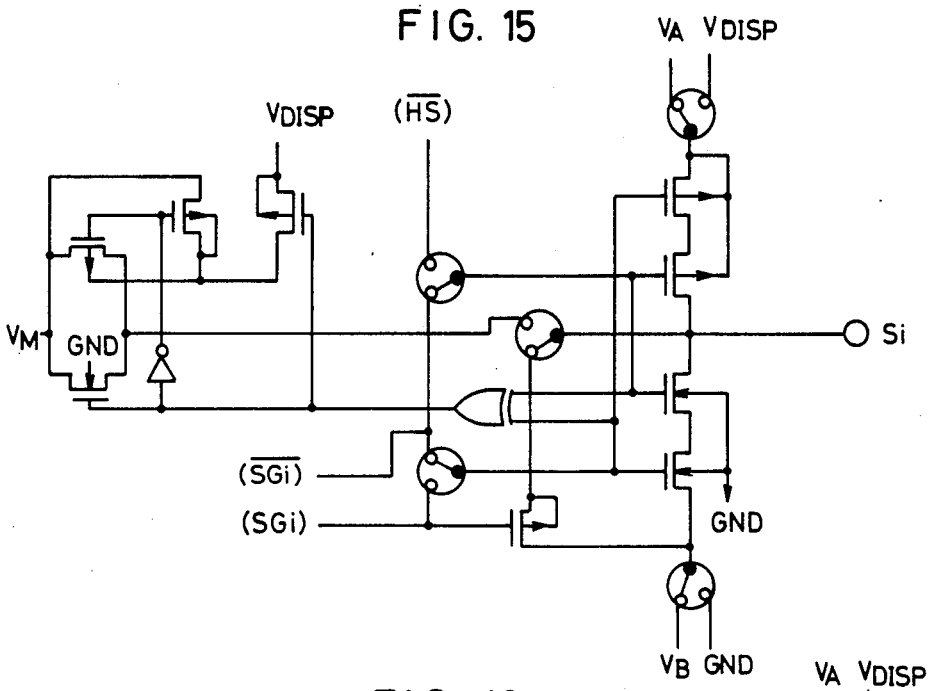
FIG. 15 shows a circuit where the first LCD driver cell shown in FIG. 12 is connected so that a segment signal can be output.
Figure 16:
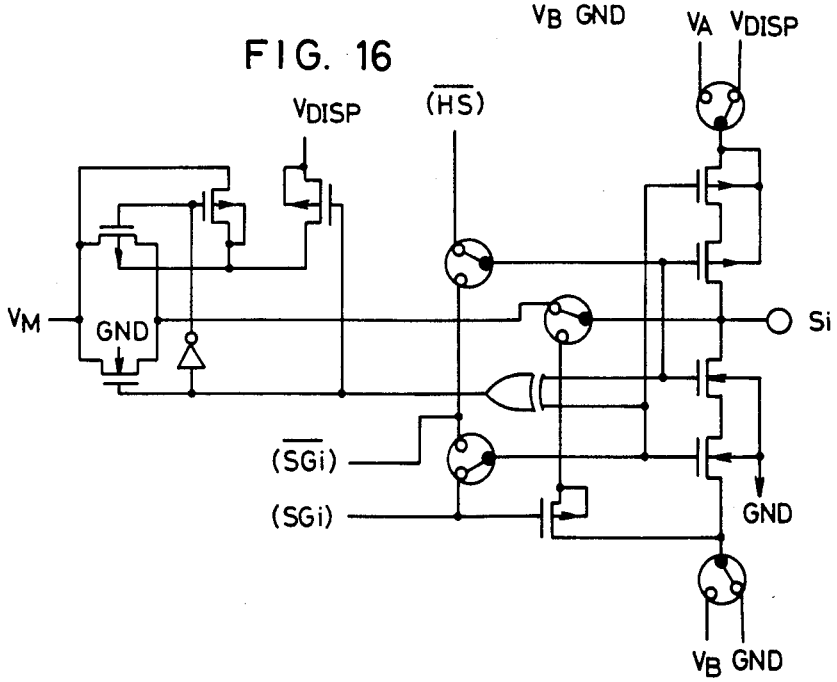
FIG. 16 shows a circuit diagram where the first LCD driver cell is connected so that a backplate signal can be output.

FIGS. 15 and 16 show the circuit connection when the driver cells are selectively used either for the segment signal or backplate signal.

As a particular advantage in the preferred embodiment of the present invention, selective signals S0 through S19 can be used by merely selecting the mode of the driver output either to the backplate or segment signal use, while both the backplate and segment signals can be processed in the identical manner as being the RAM data.

Figure 18:
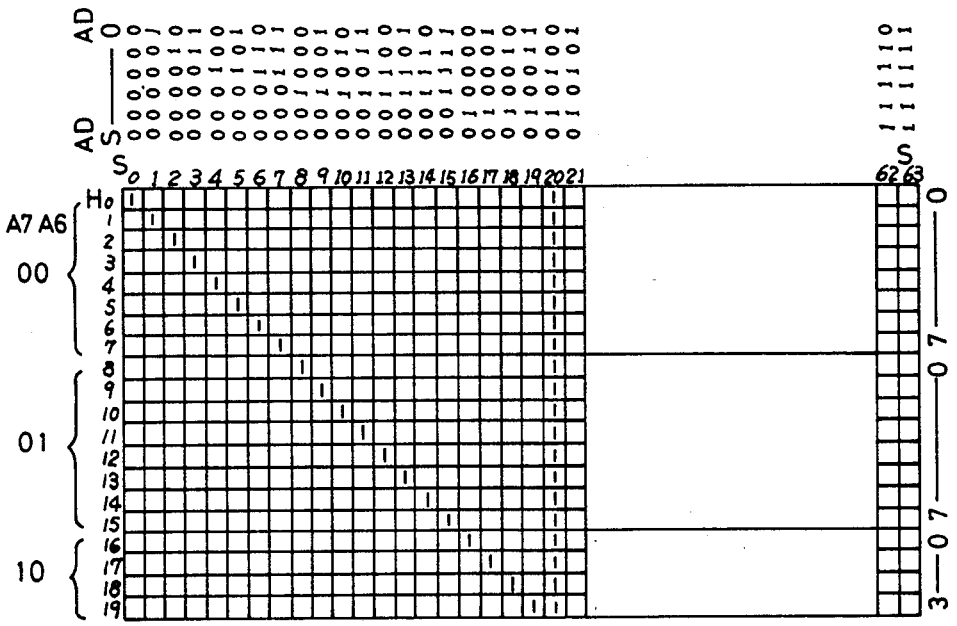
FIG. 18 shows an example of the RAM contents when a part of RAM is applied to the control of the backplate signal as a preferred embodiment of the present invention.

FIG. 18 shows the position of the RAM data when signals S0 through S19 are selected as the backplate signals, where the designated data are provided in register N in order to allow the duty factor to remain the one-twentieth of the value, while the counter h performs counting as shown in FIG. 6.

While RAM remains in the mode A7A6=00, using the H19 pulse timing, the zero bit line is then transferred to the shift register, then using the latch clock pulse $\phi$S that generates the ensuing H0 timing, the designated data is then output to flip flop SG0 through SG63.

An LCD driver shown in FIG. 16 is selected in order to drive flip flop SG0.

Since the shift register receives input signals composed of SR$\phi$+HS and SR1+HS, flip flop SG0 will output a waveform signal shown in FIG. 17 (*e*), and so flip flop SG0 eventually outputs a backplate waveform signal as shown in FIG. 17 (*a*).

Since the segment signals SG20 through SG63 are sent to the driver shown in FIG. 13, in responding to the designated contents, the driver then outputs a waveform signal, for example, the one such as shown in FIG. 17 (*b*).

If any different contents are sent to register N 18, then the duty factor against the LCD can optionally and variably be selected. Likewise, the output sequence for the backplate signal can optionally and variably be selected by merely varying the RAM data contents.

(6) Other features

The LSI provides 64 segment signals, S0 through S63. During normal operations, a plurality of the LSIs may be used. In this case, in order to select the one out from a plurality of the LSIs, chip select terminals CS0 through CS3 are provided. Using four chip select terminals, a maximum of 16 LCD driver LSIs can be connected.

The LCD driver has an auto clear device 6, as shown in FIG. 1, of which operation is described below.

As soon as the power is ON, an internal flip flop ACL will be activated. While this flip flop remains activated, the "0" data will constantly be sent to the shift register so that the shift register can disable the LCD. Using available software means, both the backplate and segment signals can be set to the initial value. If flip flop ACL is reset after the duty factor is set at a specific value, the LCD will return to a normal display mode from being OFF.

The LCD driver embodied in the present invention provides a clock pulse generator 8 which allows the driver to perform display operations by itself.

If a plurality of the drivers must be connected, one of these drivers must drive the clock pulse generator in order to oscillate the reference clock signals. Other driver LSI chips must receive said reference clock signals together with the sync signals so that the signal operations throughout the entire driver chips can correctly be synchronized.

Symbol $\phi$ shown in FIG. 1 represents the reference clock signals, while symbol H represents the sync signal which is generated at an interval of every framing operation performed by the LCD, allowing the sync signal to correctly perform synchronizing operations at an interval of every framing operation.

FIG. 7 shows that both of the counters h and C and the signal HS are reset by the sync signal H before eventually being synchronized.

Figure 19:
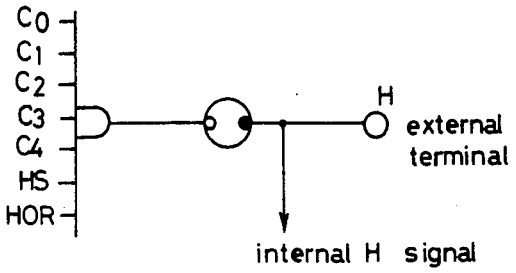
FIG. 19 shows a simplified block diagram of a circuit that generates the sync signal H.

The sync signal H is generated by the circuit shown in FIG. 19. Of all the repeatable signals, it has the longest cycle and the width of this pulse corresponds to one cycle of the clockpulse $\phi$1.

As shown in FIG. 19, the sync signal H may be sent either to external circuits or from external circuits by merely switching the mask.

As described above, the preferred embodiment of the present invention generates the backplate signals in any optional sequence, thus the present invention provides a flexible connection of the terminals between the LCD driver LSI and LCD backplate without causing the connected wires to cross each other.

Furthermore, since the duty factor can optionally be provided by an external means, it has become possible to optionally select either the display quality priority duty factor or multi picture elements priority duty factor, depending on the program selected, enabling the display system to perform extremely multifunctional variations in operation.

The present invention has made it possible to advantageously apply one kind of the LCD driver to a variety of the LCDs each having a variety of the specifications.

The present invention being thus described, it will be obvious that the same may be variably incorporated in many ways. Such variations are not to be regarded as a departure from the spirit and scope of the present invention, and all such modifications are intended to be included within the scope of the following claims.

What is claimed is:

1. A drive circuit for a display panel having display elements defined by driving backplate and segment electrodes comprising:

means for receiving data to be displayed on said panel, a plurality of drive circuit output terminals connectable to said backplate and segment electrodes in a desired fashion;

memory means, responsive to said means for receiving, for storing said data to be displayed, said data being stored in memory locations each associated with two individual output terminals connectable to backplate and segment electrodes defining a single said display element;

first addressing means, operatively connected to said memory means, for writing said data into said memory means, data associated with a particular display location being written into said memory means at a variably selectable memory location;

second addressing means, operatively connected to said memory means, for sequentially reading said data from said memory means;

drive means, responsive to said second addressing means, for converting said data read from said memory means into segment adress signals and backplate address signals and for applying said backplate drive signals to output terminals for said backplate electrodes and said segment drive signals to output terminals for said segment electrodes of said display panel to display said data received by said means for receiving;

said first addressing means addressing said memory means to select locations in said memory for said data which corresponds to the elements of said display upon which said data is to be displayed;

the addresses selected by said first addressing means being variable and the addresses used by said second addressing means being fixed so as to input information into said memory means by said first input means in a different order than said data is output from said memory means to allow said data to be displayed on displays having variable electrode arrangements.

2. The circuit of claim 1 wherein said drive means comprises an electrode driver for each said output terminal, at least some of said electrode drivers operating in a segment drive mode for driving a segment electrode or in a backplate drive mode for driving a backplate electrode.

3. The circuit of claim 1 wherein said memory means is a random access memory.

4. The circuit of claim 2 wherein said memory means is a random access memory.

5. The circuit of claim 1 wherein said display is a liquid crystal display.

6. The circuit of claim 2 wherein said display is a liquid crystal display.

7. A drive circuit for a display panel having display elements defined by driving backplate and segment electrodes comprising:

means for receiving data to be displayed on said panel;

memory means, responsive to said means for receiving, for storing said data to be displayed, said data being stored in memory locations associated with each said display element;

first addressing means, operatively connected to said memory means, for writing said data into said memory means at selectable memory locations;

second addressing means, operatively connected to said memory means, for sequentially reading said data from said memory means;

drive means, responsive to said addressing means, for converting said data read from said memory means into segment address signals and backplate address signals, and for applying said backplate address signals to said backpalte electrodes and said segment address signals to said segment electrodes of said display panel;

said drive means sequentially supplying said data to each said display element by sequentially driving each said segment electrode along a said backplate electrode to perform a single line scan, a scan of each said backplate electrode being made during a frame scan of all said display elements of said display panel, said drive means including, counter means for monitoring the number of single line scans performed by said drive means, duty cycle register means for storing a number indicative of the number of backplate electrodes to be driven in a single line scan, presettable means, responsive to said duty cycle register means, for resetting said counter means when the number stored in said counter means equals the number in said duty cycle register means to thereby begin the scan of a new frame, said duty cycle register means being presettable to vary said number and thus the number of single line scans in said frame scan to thereby vary the number of backplate drive signals applied during said frame scan to drive a desired number of backplate electrodes.

8. The circuit of claim 7 wherein said memory means is a random access memory.

9. The circuit of claim 7 wherein said display is a liquid crystal display.

10. The drive circuit of claim 7 further comprising a plurality of circuit output terminals, said drive means supplying said backplate drive signals and said segment drive signals to said terminals;

said first addressing means varying the locations of data stored in said memory means to vary the terminals to which each element of data is supplied.

11. The circuit of claim 10 wherein said drive means comprises an electrode driver for each said output terminal, at least some of said electrode drivers operating in a segment drive mode for driving a segment electrode or in a backplate drive mode for driving a backplate electrode.

12. The circuit of claim 11 wherein said memory means is a random access memory.

13. The circuit of claim 11 wherein said display is a liquid crystal display.

14. A drive circuit for driving a portion of a display panel having display elements defined by driving backplate and segment electrodes, more than one drive circuit driving a single said display panel, comprising:

means for receiving data to be displayed on said panel;

drive means, operatively connected to said means for receiving for converting said data to be displayed into segment address signals and backplate address signals, and for applying said segment address signals to said segment electrodes and said backplate address signals to said backplate electrodes;

circuit select means, responsive to said means for receiving, for monitoring said data and for determining whether said data is to be displayed on the portion of said display panel driven by said drive circuit, said circuit select means supplying said data to said drive means only if said circuit select means determines that said data is to be displayed on the portion of said display panel driven by said drive circuit;

wherein a plurality of said circuits are used to drive said display, said data containing a code indicating which said circuit is associated with the portion of said display on which said data is to be displayed;

the circuit select means of each said circuit including, code storage means for storing a circuit code uniquely associated with said circuit, and means for comparing the code contained in said data with said circuit code stored in said code storage means to determine whether said data is to be displayed on the portion of display panel driven by said drive means.

15. The circuit of claim 14 wherein said memory means is a random access memory.

16. The circuit of claim 14 wherein said display is a liquid crystal display.

* * * * *